US006609569B2

(12) United States Patent
Howlett et al.

(10) Patent No.: US 6,609,569 B2
(45) Date of Patent: Aug. 26, 2003

(54) DOWNHOLE FLUID SAMPLER

(75) Inventors: Paul David Howlett, Aberdeen (GB); George Telfer, Aberdeen (GB)

(73) Assignee: SPS-AFOS Group Limited, Westhill (GB)

( * ) Notice: Subject to any disclaimer, the term of this patent is extended or adjusted under 35 U.S.C. 154(b) by 0 days.

(21) Appl. No.: 09/975,451

(22) Filed: Oct. 11, 2001

(65) Prior Publication Data

US 2002/0043371 A1 Apr. 18, 2002

(30) Foreign Application Priority Data

Oct. 14, 2000 (GB) ..... 0025302

(51) Int. Cl.[7] ..... E21B 49/08
(52) U.S. Cl. ..... 166/264; 166/318
(58) Field of Search ..... 175/59, 232, 317, 175/50; 166/264, 318, 317

(56) References Cited

U.S. PATENT DOCUMENTS 4,787,447 A * 11/1988 Christensen ..... 175/59
4,883,123 A 11/1989 Zunkel et al.
6,065,355 A 5/2000 Schultz
6,253,861 B1 * 7/2001 Carmichael et al. ..... 175/317
6,293,342 B1 * 9/2001 McGarian et al. ..... 166/317

FOREIGN PATENT DOCUMENTS

| | | |
|---|---|---|
| EP | 0 370 606 A2 | 5/1990 |
| EP | 0 718 466 A1 | 6/1991 |
| EP | 0 534 732 A1 | 3/1993 |
| EP | 0295 922 A2 | 12/1998 |
| EP | 0 295 923 A2 | 12/1998 |
| EP | 0 903 464 A2 | 3/1999 |
| GB | 2276608 A | 10/1994 |
| GB | 2309473 A | 7/1997 |
| RU | 2108461 C | 4/1998 |

* cited by examiner

*Primary Examiner*—David Bagnell
*Assistant Examiner*—Matthew Smith
(74) *Attorney, Agent, or Firm*—Dominque & Waddell PLC

(57) ABSTRACT

A downhole tool and method of operation is described for collecting fluid samples in a downhole environment. The tool is connectable on a work string and is activated by dropping a ball through the work string. On activation a sleeve arranged on the body of the tool is caused to shift from a first to a second position thereby creating a chamber between the sleeve and body. The sample fluid is drawn into the chamber as it is created and is prevented from exiting by a non-return valve. The tool locks the sleeve in the second position to fix the chamber. The sample can then be retrieved along with the tool.

13 Claims, 2 Drawing Sheets

DOWNHOLE FLUID SAMPLER

The present invention relates to an apparatus and method for taking a sample of downhole fluid.

In oil and gas operations it is often necessary to take samples of fluid from the downhole well bore. These samples can then be brought back to the surface for analysis. Such procedures are commonly used during well-bore clean up operations to verify cleanliness and the effectiveness of said operations.

Various tools have been developed for the purpose of taking downhole fluid samples. Typically these tools comprise a sampling means which is run into a well bore on a tubing string in combination with a packer means for isolating a well annulus portion. The tool comprises an activation means which is usually biased into a closed position and can be moved from the closed position to an open position by a pressure change or electrical signal.

In the open position the sampling means communicates with the isolated well bore annulus to allow a sample of the downhole contents to be taken. The activation means returns to the closed position via the bias means when the previously applied pressure or electrical signal is removed or terminated. In other tools where the activation means is not biased into a closed position, the electrical signal or pressure increase is applied further to move the activation means to a second closed position, after the sample has been taken.

A disadvantage of conventional sampler tools lies in the fact that efficient working of these tools relies on the bias means functioning properly to re-close the moveable activation means, or a further increase in pressure (pressuring-up) or electrical signal to close the sampling means. Where the sample is required from a particular area or depth within the well it is essential that the sampling means is closed as the tool is removed or tripped from the hole so that the sample is not lost or contaminated.

It is an object of the present invention to provide an improved sampling tool for collecting samples of fluid in a downhole environment and bringing said samples to the surface.

According to a first aspect of the present invention there is provided a downhole sampler tool for extracting a sample of fluid from a well bore, the sampler tool being comprised of a cylindrical body connectable on a workstring, the body having a throughbore therein, an outer sleeve arranged on the body and an activation means, wherein the activation means causes the outer sleeve to be moved axially from a first to a second position thereby creating a sampling chamber into which the sample of fluid is drawn.

Preferably the tool further includes a non return valve through which the fluid is drawn into the chamber as the outer sleeve is moved.

Preferably the tool also comprises a locking means which locks the outer sleeve into the second position.

Advantageously the locking means comprises a snap ring into which a portion of the outer sleeve engages in the second position.

Typically the activation means comprises a drop ball which communicates with a drop ball seat in the tool.

Preferably the tool further includes an inner sleeve located in the throughbore the inner sleeve being interconnected to the outer sleeve. The inner and outer sleeves may be mechanically coupled by way of a bolt, for example. Thus the activation means may cause the movement of the outer sleeve by virtue of moving the inner sleeve.

Advantageously the tool also comprises a by pass means to allow circulation of fluid through the throughbore of the cylindrical body after the fluid sample has been taken. Preferably the by pass means is a fluid passage accessed by movement of a by pass sleeve by the activation means.

In order to prevent movement of any of the sleeves when the tool is deployed the sleeves may be held in the first position by shear pins which shear on action of the drop ball.

According to a second aspect of the present invention there is provided a method of taking a fluid sample downhole comprising the steps of:

a) running a fluid sampler tool downhole;
b) activating the tool to create a chamber into which the fluid sample is drawn; and
c) retrieving the tool with the fluid sample.

Preferably the method includes the step of drawing the fluid through a one-way valve to seal the fluid sample in the chamber.

Preferably also the method includes the step of locking the tool after the sample has been taken so that the chamber is fixed before retrieval.

Typically the method includes the step of activating the tool is achieved by a drop ball mechanism.

According to a third aspect of the present invention there is provided a method of taking a fluid sample downhole comprising the steps of:

a) running a fluid sampler tool downhole; the fluid sampler tool having a cylindrical body, throughbore, drop ball seat and moveable inner and outer sleeves which are mechanically connected and held to the body by shear pins;
b) rupturing said shear pins to allow said inner and outer sleeves to move relative to the body by landing a drop ball in the drop ball seat, wherein movement of the inner and outer sleeves creates a chamber having a one way valve into which downhole fluid is drawn; and
c) retrieving the fluid sampler tool containing the fluid sample in the chamber means.

An example embodiment of the invention will now be illustrated with reference to the following Figures in which.

Figure 1:
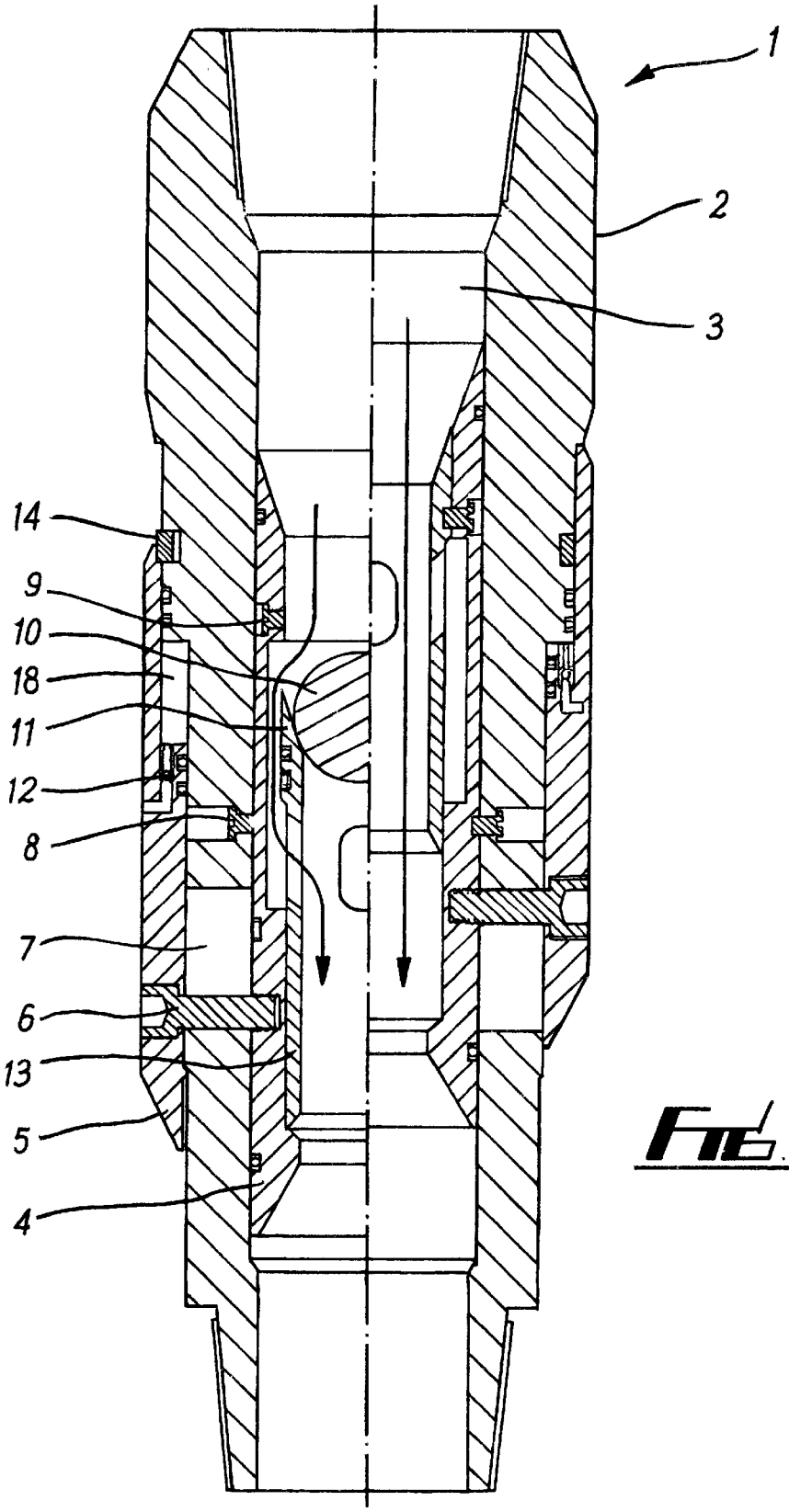
FIG. 1 illustrates a fluid sampler tool in accordance with the present invention.

Referring firstly to FIG. 1 a downhole fluid sampler tool in generally depicted at 1. The sampler 1 comprises a generally cylindrical body 2 which is attached to a work string (not shown). The body 2 has a throughbore 3, through which fluid can pass and an inner 4 and outer 5 sleeve which are mechanically connected via bolts 6 through slots 7 in the cylindrical body 2.

Figure 2:
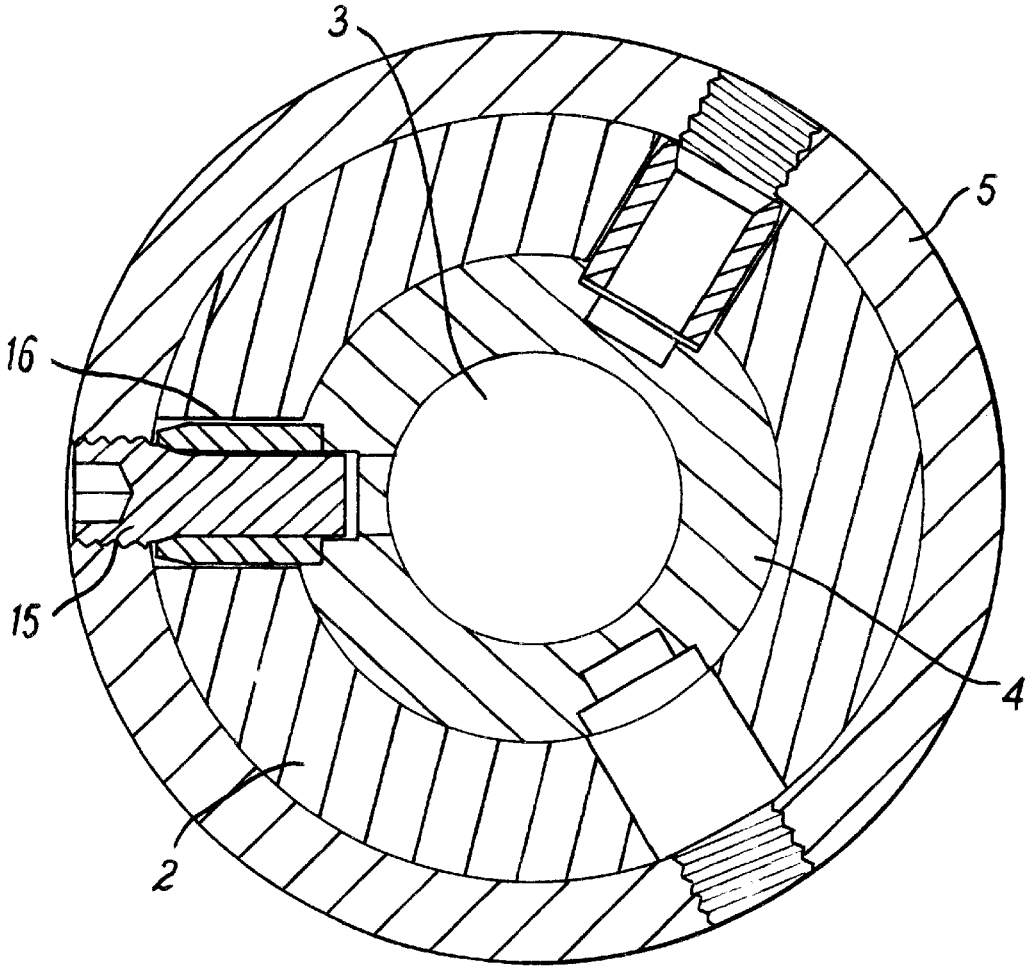
FIG. 2 shows a cross section of the inner and outer sleeves of the fluid sampler tool of FIG. 1

The inner 4 and outer 5 sleeves are held in a first position (shown on the right hand side of FIG. 1) by shear screws 8 and 9. The tool 1 is run into the well bore with the inner 4 and outer 5 sleeves held in the first position by the shear screws 8 and 9. This allows fluid to flow through the throughbore 3 in the direction of the arrow. FIG. 2 illustrates a cross sectional view taken through the tool 1 shown in FIG. 1. It can be seen from FIG. 2 that the inner 4 and outer 5 sleeve are held in relative positions to the body 2 by modified grub screw 15 and stud collar 16.

When a sample of downhole fluid is required to be taken the tool 1 is activated by inserting a drop ball 10 into the fluid flow. The drop ball 10 passes through the through bore 3 until it comes to rest on a corresponding drop ball seat 11 within the through bore 3. When the drop ball 10 is seated in seat 11, fluid flow through the bore 3 will be substantially restricted and as a consequence the fluid pressure above the drop ball 10 will build up. The pressure increases until the shear pin 8 reaches its shearing point. When the shear pin 8 breaks the inner 4 and outer 5 sleeves will be released from the body 2 arid are forced to move axially relative to the body 2, that is in a downward direction to a second position as illustrated on the left hand side of FIG. 1. As the outer 5 sleeve moves relative to the body 2 a sampling means or area substantially resembling a chamber 18 will be exposed into which a fluid sample can enter. It will be appreciated that the fluid sample may enter or be drawn into the chamber 18 by suction. The chamber 18 has a one way, or non return check valve 12. The check valve 12 allows fluid to enter the chamber 18 but prevents the sample leaving the chamber 18.

The tool 1 also comprises a by pass sleeve 13 which moves relative to the body 2 by virtue of the drop-ball 10 landing on the seat 11 and shearing pin 9. This is of particular advantage as it allows continued fluid circulation through the through bore 3 of the tool 1 after the sample has been taken by virtue of pin 9 shearing after pin 8, their shearing points being selected accordingly. The re-directed fluid circulation, flows through a by-pass channel created by pass sleeve 13 and is illustrated by the arrow on the left hand side of FIG. 1. It is recognised that this is of particular benefit if the tool 1 is incorporated, for example, into a drill string (not shown), as normal fluid circulation throughout the tool body 1 will not be disrupted by the drop ball 10 and as a consequence normal operation of the drill string can be continued during and after the fluid sample has been taken.

The purpose of taking a downhole sample of fluid is such that it can be analysed in composition to retrieve information for example on the conditions down hole, or whether a well clean-up operation has been successful. It will be appreciated that in order to carry this out, the sample must be brought back up to the surface of the well bore and retrieved from the sampler tool. In the present invention, the sample chamber 18 is located external to the body 2 of the tool 1 and can be easily retrieved. Furthermore, the sample will not be lost from chamber 18 as the tool is "tripped" from the bore, as the chamber 18 has a one way valve 12 which retains the sample in the chamber 5. Furthermore, the outer sleeve 5 remains locked in the second position by virtue of communicating with a snap ring 14. Therefore a further advantage of the present invention lies in the fact that it does not requite a bias means or system for closing or encapturing the fluid sample once said sample has been taken.

It is also recognised that several fluid sampler tools could be run in a workstring to take samples before, during and after a well-bore clean up operation to verify cleanliness of the fluid after the operation in comparison to the fluid sampled prior to the clean up operation.

Further modifications and improvements may be incorporated without departing from the scope of the invention herein intended.

What is claimed is:

1. A downhole sampler tool for extracting a sample of fluid from a well bore, the sampler tool being comprised of a cylindrical body connectable on a workstring, the body having a through bore therein, an outer sleeve arranged on the body, a non-return valve, and an activation means, wherein the activation means causes the outer sleeve to be moved axially from a first to a second position, thereby creating a sampling chamber into which the sample of fluid is drawn through the non-return valve.

2. A downhole sampler tool as claimed in claim 1 wherein the tool also comprises a locking means which locks the outer sleeve into the second position.

3. A downhole sampler tool as claimed in claim 2 wherein the locking means comprises a snap ring into which a portion of the outer sleeve engages in the second position.

4. A downhole sampler tool as claimed in claim 1 wherein the activation means comprises a drop ball which communicates with a drop ball seat in the tool.

5. A downhole sampler tool as claimed in claim 1 wherein the tool further includes an inner sleeve located in the throughbore, the inner sleeve being interconnected to the outer sleeve.

6. A downhole sampler tool as claimed in claim 5 wherein the activation means causes the movement of the outer sleeve by virtue of moving the inner sleeve.

7. A downhole sampler tool as claimed in claim 1 wherein the tool also comprises a by pass means to allow circulation of fluid through the throughbore of the cylindrical body after the fluid sample has been taken.

8. A downhole sampler tool as claimed in claim 7 wherein the by pass means is a fluid passage accessed by movement of a by pass sleeve by the activation means.

9. A downhole sampler tool as claimed in claim 7 wherein the sleeve is held in the first position by a shear pin.

10. A method of taking a fluid sample downhole comprising the steps of:

a) running a fluid sampler tool downhole;

b) activating the tool to create a chamber;

c) drawing fluid sample through a one way valve to seal the fluid in the chamber; and d) retrieving the tool with the fluid sample.

11. The method of claim 10 further including the step of locking the tool after the sample has been taken so that the chamber is fixed before retrieval.

12. The method of claim 10 wherein the step of activating the tool is achieved by a drop ball mechanism.

13. A method of taking a fluid sample downhole comprising the steps of:

a) running a fluid sampler tool downhole; the fluid sampler tool having a cylindrical body, through bore, drop ball seat and moveable inner and outer sleeves which are mechanically connected and held to the body by shear pins;

b) rupturing said shear pins to allow said inner and outer sleeves to move relative to the body by landing a drop ball in the drop ball seat, wherein movement of the inner and outer sleeves creates a chamber having a one way valve into which downhole fluid is drawn; and c) retrieving the fluid sampler tool containing the fluid sample in the chamber.

* * * * *